US012607412B2

(12) United States Patent
Shah et al.

(10) Patent No.: US 12,607,412 B2
(45) Date of Patent: Apr. 21, 2026

(54) EXHAUST GAS HEAT EXCHANGER WITH TWISTED RESTRICTOR

(71) Applicant: RB Distribution, Inc., Colmar, PA (US)

(72) Inventors: Rajan Sunilkumar Shah, Eagleview, PA (US); Stephen B. Miller, Glenside, PA (US); Robert Jules Pisch, Willow Grove, PA (US)

(73) Assignee: RB Distribution, Inc., Colmar, PA (US)

( * ) Notice: Subject to any disclaimer, the term of this patent is extended or adjusted under 35 U.S.C. 154(b) by 348 days.

(21) Appl. No.: 18/193,006

(22) Filed: Mar. 30, 2023

(65) Prior Publication Data

US 2024/0328720 A1 Oct. 3, 2024

(51) Int. Cl.

| | |
|---|---|
| ***F28F 27/00*** | (2006.01) |
| ***F28D 7/16*** | (2006.01) |
| ***F28D 21/00*** | (2006.01) |

(52) U.S. Cl.
CPC ..... *F28D 7/1684* (2013.01); *F28D 21/00* (2013.01); *F28D 2021/008* (2013.01)

(58) Field of Classification Search
CPC ... F28D 7/1684; F28D 21/00; F28D 2021/008
USPC ..... 165/96
See application file for complete search history.

(56) References Cited

U.S. PATENT DOCUMENTS

| | | | | |
|---|---|---|---|---|
| 6,141,961 | A | 11/2000 | Rinckel | |
| 6,240,725 | B1 * | 6/2001 | Scappatura | F01N 3/04 60/309 |
| 7,243,707 | B2 | 7/2007 | Brost | |

FOREIGN PATENT DOCUMENTS

EP 0354012 A2 * 2/1990

* cited by examiner

*Primary Examiner* — Davis D Hwu
(74) *Attorney, Agent, or Firm* — Volpe Koenig

(57) ABSTRACT

A heat exchanger having selected heat exchanger tubes that includes a flow restrictor that causes a non-linear flow through the heat exchanger tubes.

22 Claims, 4 Drawing Sheets

EXHAUST GAS HEAT EXCHANGER WITH TWISTED RESTRICTOR

BACKGROUND

Exhaust gas heat exchangers are used in exhaust systems of internal-combustion engines of motor vehicles to transfer heat from the exhaust gasses to a liquid cooling system of the engine. In some arrangements, the exhaust gas heat exchanger is provided in a bypass of a main exhaust pipe which allows the exhaust gasses to be selectively diverted from the main exhaust pipe through the exhaust gas heat exchanger during certain periods of operation.

When there is a cold engine start, the exhaust gas heat exchanger can transfer heat from the exhaust gasses to the cooling system to more rapidly bring the system up to a desired operating temperature.

SUMMARY

A heat exchanger with a heat exchange chamber in fluid communication between the fluid inlet and the fluid outlet of the exchanger. Within the exchange chamber there are a plurality of heat exchanger tubes, and at least some of heat exchanger have a twisted heat flow restrictor positioned within the selected heat exchanger tubes.

BRIEF DESCRIPTION OF THE DRAWINGS

The Detailed Description will be better understood when read in conjunction with the appended drawings in which.

DETAILED DESCRIPTION

Figure 1:
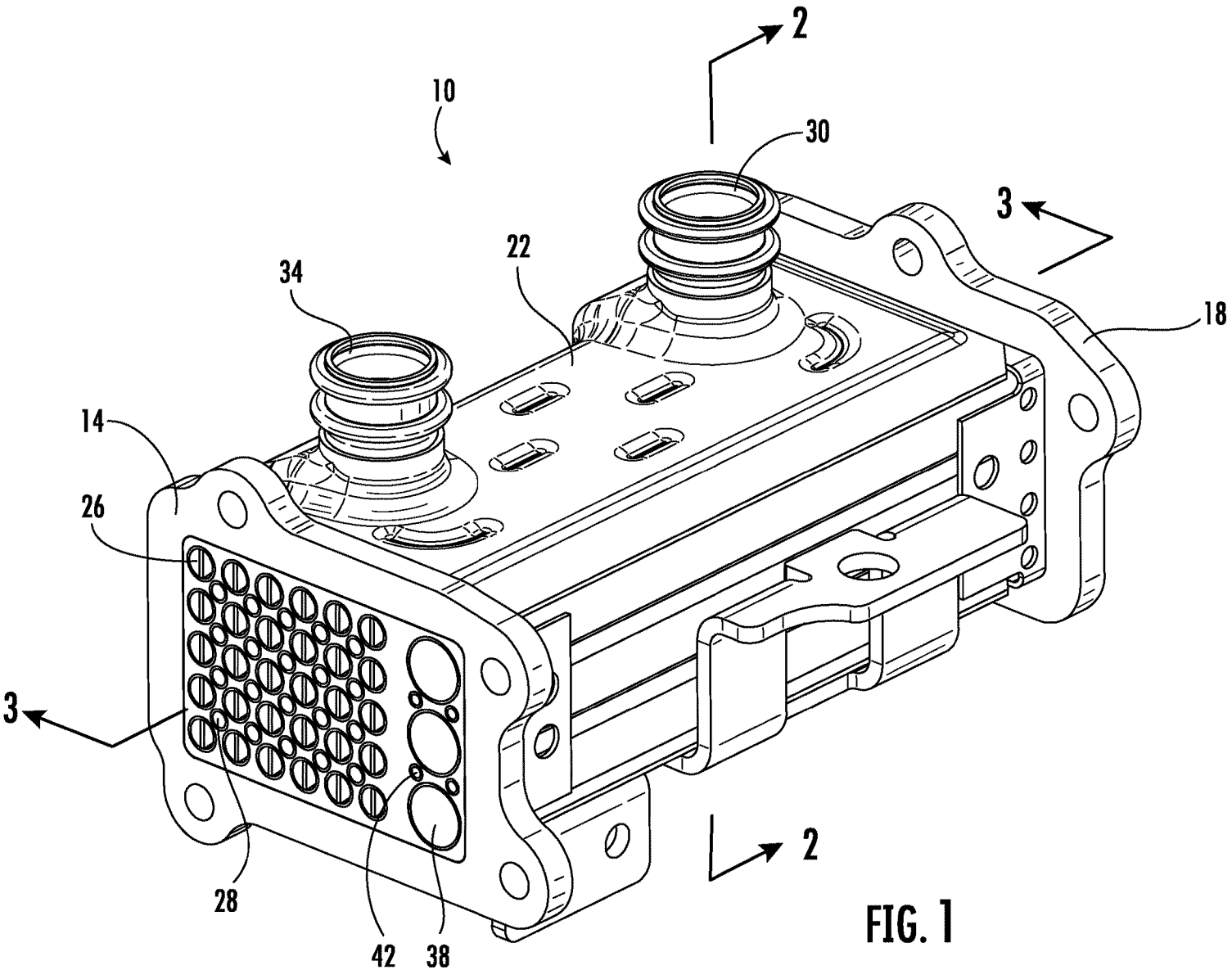
FIG. 1 is a perspective view of a heat exchanger for an exhaust system.

The description will be made with reference to the drawings like reference numerals identify the same or similar features of the heat exchanger.

An exemplary exhaust gas heat exchanger 10 is shown in FIG. 1. For most new power trains and exhaust systems, the original equipment manufacturer will provide a heat exchanger having a specified envelope or outer geometry selected by the original equipment manufacturer or a parts vendor. The disclosed heat exchanger will have an envelope or outer geometry that is compatible with an existing exhaust system while including the current features. Typically, the original heat exchanger will have a designated fluid flow pattern and heat exchange capacity. A typical heat exchanger 10 has an inlet face with a flange 14 for securing the heat exchanger 10 in the corresponding structure of the exhaust system and receiving exhaust gas from the exhaust system and an outlet face with a flange 18 for connection with an additional exhaust system component. Accordingly, the dimensions of the inlet face and the flange 14, the outlet face and the flange 18, and the envelope of the exchanger 10 are selected to fit with and mate the original equipment manufacturer's original system.

Figure 2:
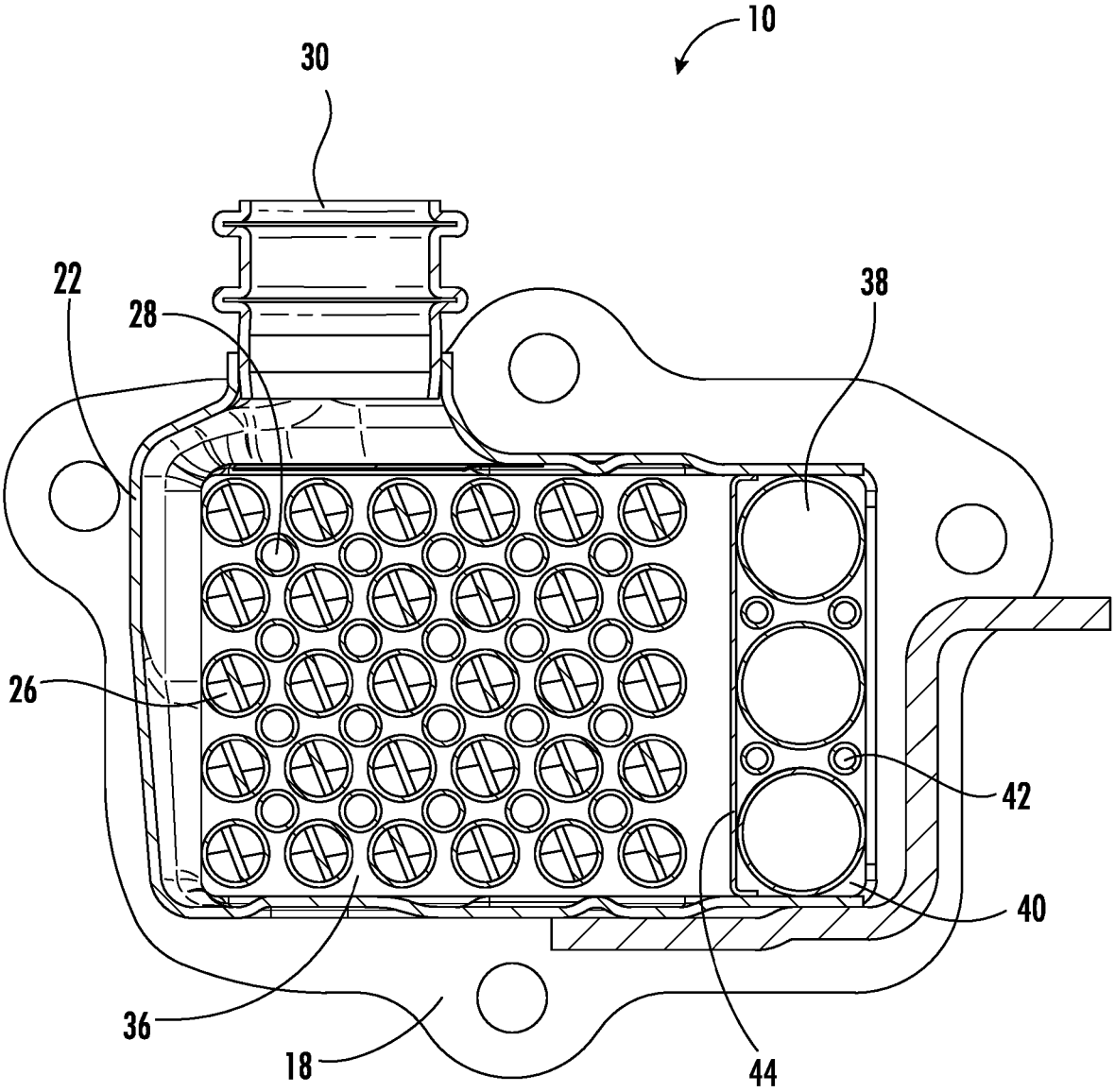
FIG. 2 is a cross-sectional view of taken along the line 2-2 in FIG. 1.
Figure 3:
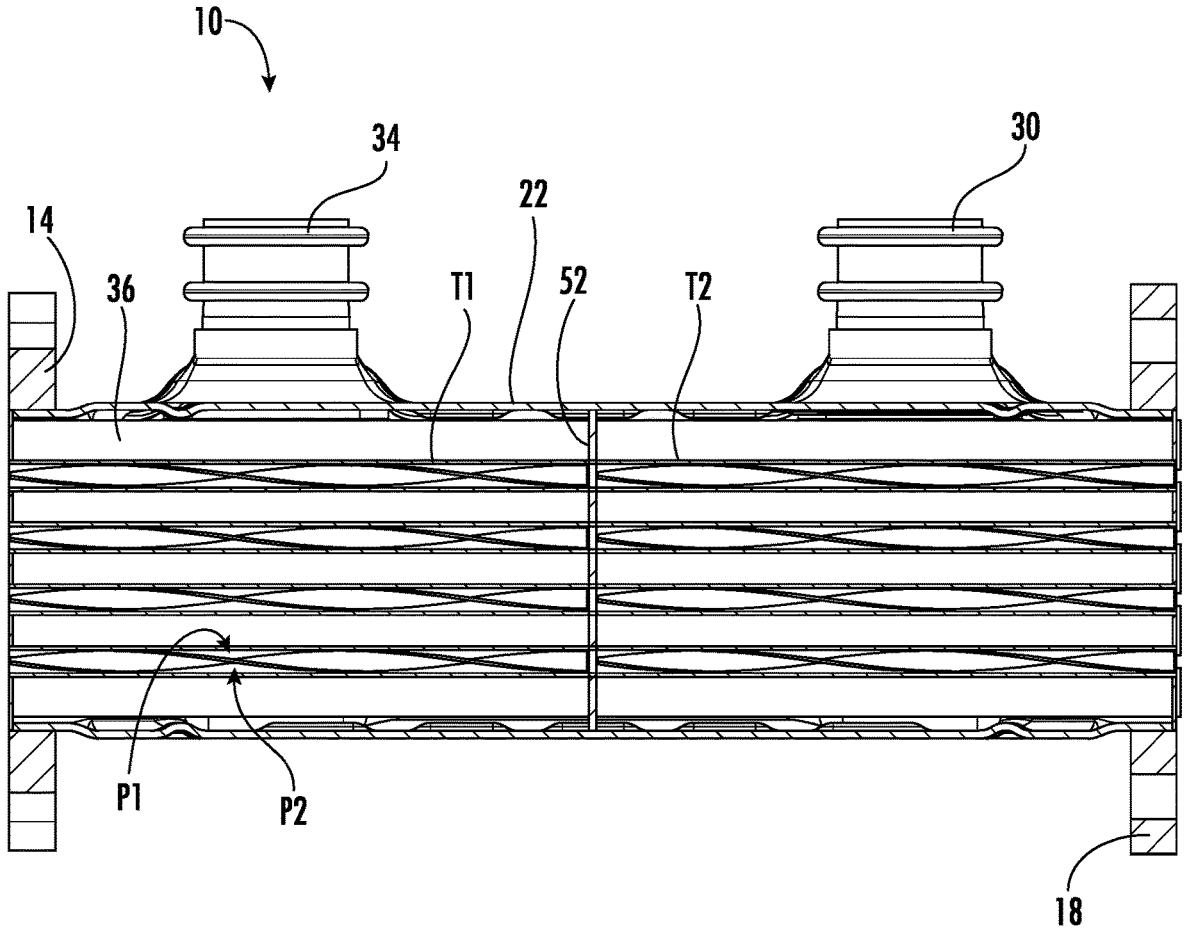
FIG. 3, a cross-sectional view taken along the line 3-3 in FIG. 1, illustrate the internal flow pattern through the heat exchanger.

With reference to FIGS. 1 through 3, the envelope or housing 22 of heat exchanger 10 includes a coolant flow chamber 36 that has a plurality of longitudinal heat exchanging tubes 26 that form flow conduits through which exhaust gasses pass between the inlet face and the outlet face. The housing 22 also supports a plurality of longitudinal backpressure reducing tubes 28 that are between rows or columns of heat exchange tubes 26. The longitudinal backpressure reducing tubes 28 also form conduits through which exhaust gasses flows between the inlet face and the outlet face. The longitudinal backpressure reducing tubes 28 have a diameter that is approximately half of the diameter of the longitudinal heat exchanging tubes 26.

With reference to again to FIGS. 1 and 3, the fluid inlet tube 30 receives fluid from an engine cooling system and the fluid outlet 34 returns heated fluid to a component of the vehicle, such as a heater core or the like. In a typical cooling system, the fluid is under pump pressure which achieves a desired flow rate. The fluid from the fluid inlet tube 30 flows through the chamber 36 and around the heat exchanger tubes 26 and backpressure reducing tubes 28 to extract heat from the exhaust gasses and exits through the fluid outlet 34. Accordingly, exhaust gas flows longitudinally through the heat exchanger tubes with the coolant flowing through the exchanger between the inlet 30 and the outlet 34.

As shown in FIG. 2, the array of heat exchange tubes 26 and the array of backpressure reducing tubes 28 are aligned vertically and horizontally in the respective array, and the arrays are offset with respect to each other so that the backpressure reducing tubes 28 are nested among heat exchange tubes 26.

Still with reference to FIG. 2, wall 44 separates the coolant fluid chamber 36 from an exhaust gas bypass camber 40 that includes a plurality of longitudinal bypass tubes 38 and 42. The bypass camber 40 has ambient air around the tubes 38 and 42, and the tubes 38 and 42 do not restrict the exhaust gas flow or cause a pressure drop. The primary or intended heat exchange takes place as exhaust gas passes through the tubes 26 and 28 that are located within the coolant fluid that passes through chamber 36.

Still with reference to FIGS. 2 and 3, each heat exchange tube 26 is comprised of two components C1 and C2 that are arranged end to end within the housing 22 in a fluid tight connection with the inlet face 14 and the outlet face 18. The exchange tubes 26 are also supported within the housing 22 by the interior wall 52.

Figure 4:
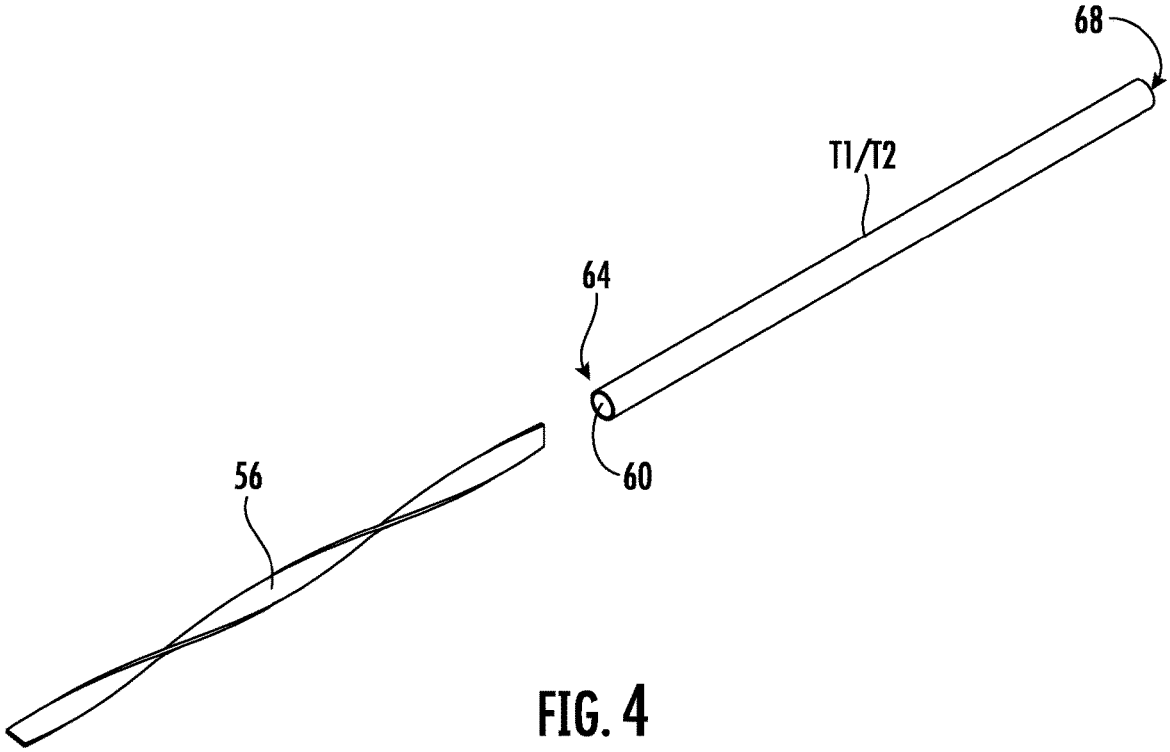
FIG. 4 is an exploded view of a heat exchange tube and flow restrictor prior to assembly and insertion in a heat exchanger.
Figure 5:
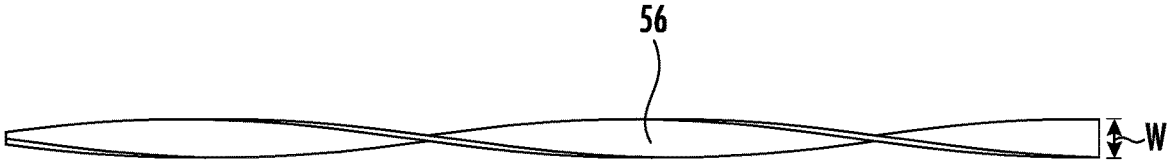
FIG. 5 is a side elevation view of the flow restrictor in FIG. 4.

With reference to FIGS. 4 and 5, each tube component C1 is essentially a hollow tube 60, that is like a straw, and each tube component C2 is an elongated metal insert 56 that is twisted or convoluted about its longitudinal axis so that a flow over the twisted insert 56 rotates the flow around the insert 56. For example, the tubular component C1 can have an inner diameter of approximately 5.3 centimeters and the twisted component C2 can have an outer diameter of approximately 5.2 centimeters. This difference between the inner diameter of C1 and the outer diameter of C2 limits gas escaping past C2 within C1. The twisted component C2 extends longitudinally between the end 60 and 68 of C1 and is stationary within C1. Exhaust gas weaves around the twisted component C2 and this creates a desired resident time within C1 to achieve the heat transfer with both turbulent and laminar flow conditions.

The restrictor 56 in the illustrated example is twisted approximately 450 degrees from end to end along its length. By way of example, the twisted internal restrictor 56 can be formed by twisting opposite ends of a flat strip of material approximately 450 degrees relative to each other. The twisted internal restrictor 56 generally divides the central passageway 60 into two flow paths P1 and P2 (see FIGS. 2 and 3) such that the flow of exhaust gasses through the tube segment T1/T2 is diverted about a longitudinal axis of the central passageway 60. In particular, the twisted internal restrictor 56 creates helical flow paths P1 and P2 that wrap or otherwise extend around a longitudinal axis of the central passageway 60.

In the illustrated embodiment, the tube segments T1 and T2 are aligned axially in end-to-end fashion. The angular orientation of each tube segment T1/T2 is the same, as best seen in FIG. 3. Accordingly, the twisted internal restrictor 56 of each tube segment T1/T2 share a common orientation. This creates an abrupt transition between the flow paths P1 and P2 of the tube segments T1 and T2 in the region of the intermediate flange 52.

It will be appreciated that the degree of twist of the twisted internal restrictor 56 affects the amount of pressure drop across the heat exchanger 10 of the exhaust gasses passing therethrough. A higher degree of twist results in a higher pressure drop and more heat transfer as the exhaust gasses are forced to travel a longer path through the heat exchanger 10. A lower degree of twist results in a lower pressure drop and less heat transfer as the exhaust gasses are allowed to flow more directly through the heat exchanger 10. Accordingly, the heat transfer characteristics of the heat exchanger 10 can be tailored by adjusting the degree of twist of the internal restrictor 56.

To maintain an acceptable backpressure of the exhaust gasses at the inlet flange 14, the backpressure reducing tubes 28 allow generally unrestricted flow of exhaust gasses through the heat exchanger 10. Thus, any increase in backpressure caused by the heat exchanger tubes 26 can be offset by the backpressure reducing tubes 28 resulting in the heat exchanger 10 achieving acceptable backpressure, flow rate, and pressure drop of the exhaust gasses.

The bypass value is functionality consistent with the original equipment and complies with federal regulations.

The bypass tubes 38 and 42 are largely isolated with the housing 22 by the wall 44 so that the flow of exhaust gases through the heat exchanger 10 is generally unrestricted, in general, limited or no heat transfer between the exhaust gasses and the cooling fluid. The bypass valve is typically open at engine start and is closed by the vehicle ECU when the operating temperature is reached. Switching the flow path of the exhaust gases between the heat exchanger tubes 26 and backpressure reducing tubes 28, and the bypass tubes 38 and 42 is generally handled by a valve or other diverting mechanism upstream from the heat exchanger 10 (not shown).

In operation, when exhaust gasses are directed through the heat exchanger tubes 26 and backpressure reducing tubes 28, the cooling fluid flowing through the housing 22 between the inlet 30 and outlet 34 circulates around the heat exchanger tubes 26 and the backpressure reducing tubes 28 to absorb heat from the exhaust gases. This results in a temperature decrease of the exhaust gasses, a temperature increase in the cooling fluid, and a pressure drop in the exhaust gasses as they flow through the heat exchanger 10. Various aspects of the heat exchanger 10 are configured to achieve acceptable heat transfer, pressure drop and exhaust backpressure to meet OEM performance parameters.

The invention claimed is:

1. A heat exchanger, comprising:

a housing having an inlet face, an outlet face, and a coolant fluid chamber between the inlet face and the outlet face;

a plurality of heat exchanger tubes is mounted within the coolant fluid chamber;

at least one of the heat exchanger tube among the plurality of heat exchanger tubes includes a flow restrictor; and, the plurality of heat exchanger tubes mounted within the coolant fluid chamber have a first array of heat exchanger tubes with a first diameter and a second array of heat exchanger tubes with a second, smaller diameter.

2. The heat exchanger according to claim 1, wherein the flow restrictor rotates the flow within the at least one of the heat exchanger tube about a longitudinal axis in the heat exchanger tube.

3. The heat exchanger of claim 2, wherein the flow restrictor is a metallic strip that has a plurality of longitudinal twists.

4. The heat exchanger according to claim 1, wherein multiple heat exchanger tubes among the among the plurality of heat exchanger tubes include a flow restrictor.

5. The heat exchanger of claim 1, wherein selected heat exchanger tubes in the first array have a flow restrictor.

6. The heat exchanger of claim 1, wherein the second array of heat exchanger tubes is nested within the first array of heat exchanger tubes.

7. The heat exchanger of claim 6, wherein the heat exchanger tubes in the first array and the heater exchanger tube in the second array are aligned vertically.

8. The heat exchanger of claim 6, wherein the heat exchanger tubes in the first array and the heater exchanger tube in the second array are aligned both vertically and horizontally.

9. The heat exchanger according to claim 1, wherein the flow restrictor creates at least two flow paths within the at least one heat exchanger tube.

10. The heat exchanger according to claim 9, wherein the two separate flow paths are helical flow paths extending around a longitudinal axis of the at least one heat exchanger tube.

11. The heat exchanger according to claim 1, further comprising: a flow restrictor in each of the plurality of heat exchanger tubes.

12. The heat exchanger according to claim 11, wherein the plurality of heat exchanger tubes mounted within the coolant fluid chamber have a first array of heat exchanger tubes with a first diameter and a second array of heat exchanger tubes with a second smaller diameter.

13. The heat exchanger of claim 11, wherein the flow restrictor in each of the plurality of heat exchanger tubes is twisted along the flow restrictor's axial length by approximately 450 degrees.

14. A heat exchanger, comprising:

a housing having an inlet face, an outlet face, and a coolant fluid chamber between the inlet face and the outlet face;

a plurality of heat exchanger tubes is mounted within the coolant fluid chamber;

at least one of the heat exchanger tube among the plurality of heat exchanger tubes includes a flow restrictor; and, at least one backpressure reducing tube in the housing.

15. The heat exchanger of claim 14, wherein a wall within the housing separates the at least one backpressure reducing tube and the coolant fluid chamber.

16. A heat exchanger tube assembly for an exhaust gas heat exchanger, the assembly comprising:

an elongated tube with a predetermined length; and, a twisted flow restrictor that is secured within the elongated tube and causes exhaust gas through the elongated tube to have a non-linear flow through the elongated tube, wherein the twisted flow restrictor creates two separate flow paths through the elongated tube.

17. The heat exchanger tube according to claim 16, wherein the non-linear flow is about a longitudinal axis of the elongated tube.

18. The heat exchanger tube according to claim 16, wherein the two separate flow paths are helical flow paths extending around a longitudinal axis of the elongated tube.

19. The heat exchanger tube according to claim 16, wherein the twisted flow restrictor is metallic.

20. The tube according to claim 16, wherein the twisted flow restrictor is twisted along a longitudinally axis between a first and a second end by approximately 450 degrees.

21. A tube kit for use in assembling a heat exchanger, the kit comprising:

a first plurality of elongated tubes that have a predetermined length, a first interior diameter; and, a twisted flow restrictor that is secured within the first interior diameter; and, a second plurality of elongated tubes that have a second interior diameter that is less than the first interior diameter and the second plurality of elongated tubes is unrestricted.

22. The tube kit of claim 21, wherein the twisted flow restrictor causes a non-linear flow the flow through the first plurality of elongated tubes.

* * * * *